US007722404B2

(12) United States Patent
Neumetzler

(10) Patent No.: US 7,722,404 B2
(45) Date of Patent: May 25, 2010

(54) PLUG-IN CONNECTOR FOR PRINTED CIRCUIT BOARDS

(75) Inventor: Heiko Neumetzler, Berlin (DE)

(73) Assignee: ADC GmbH, Berlin (DE)

( * ) Notice: Subject to any disclaimer, the term of this patent is extended or adjusted under 35 U.S.C. 154(b) by 8 days.

(21) Appl. No.: 11/718,120

(22) PCT Filed: Oct. 31, 2005

(86) PCT No.: PCT/EP2005/011637

§ 371 (c)(1),
(2), (4) Date: Jan. 6, 2009

(87) PCT Pub. No.: WO2006/048220

PCT Pub. Date: May 11, 2006

(65) Prior Publication Data

US 2009/0130890 A1 May 21, 2009

(30) Foreign Application Priority Data

Nov. 5, 2004 (DE) ..... 10 2004 054 535

(51) Int. Cl.
*H01R 24/00* (2006.01)

(52) U.S. Cl. ..... 439/636; 439/404

(58) Field of Classification Search ..... 439/629–637, 439/404, 405

See application file for complete search history.

(56) References Cited

U.S. PATENT DOCUMENTS 3,524,161 A 8/1970 Frantz et al.
6,050,842 A 4/2000 Ferrill et al.
7,182,524 B2 2/2007 Kramer et al.
2006/0286824 A1 * 12/2006 Busse et al. ..... 439/65

FOREIGN PATENT DOCUMENTS

| | | |
|---|---|---|
| DE | 26 26 956 | 12/1977 |
| DE | 199 45 412 A1 | 3/2000 |
| DE | 101 41 449 A1 | 3/2003 |
| DE | 102 57 308 B3 | 7/2004 |
| TW | 366148 | 4/1987 |

* cited by examiner

*Primary Examiner*—Ross N Gushi
(74) *Attorney, Agent, or Firm*—Merchant & Gould P.C.

(57) ABSTRACT

The invention relates to a plug-in connector for printed circuit boards, comprising a plurality of contact elements, whereby said contact elements have two connecting faces each. The one connecting face is configured as an insulation displacement contact for connecting cores and the other connecting face is configured as a tuning fork contact for contacting contact surfaces on a printed circuit board. The insulation displacement contacts of the contact elements can be inserted into a plastic housing. The insulation displacement contact and the tuning fork contact are arranged in a rotational manner in relation to each other and the contact element is supported on the plastic housing by at least one edge, such that the contact elements are captivated in the plastic housing when connecting forces act upon the insulation displacement contacts. The plastic housing is embodied as a single piece and the part receiving the tuning fork contact is at least partially elastic.

11 Claims, 2 Drawing Sheets

PLUG-IN CONNECTOR FOR PRINTED CIRCUIT BOARDS

DE 199 45 412 A1 and DE 102 57 308 B3 respectively disclose a plug-in connector for printed circuit boards, comprising a number of contact elements, the contact elements respectively having two connection sides, the one connection side being formed as an insulation-piercing contact for the connecting of wires and the other connection side being formed as a bifurcated contact for the contacting of terminal areas on a printed circuit board, and a plastic housing, in which the insulation-piercing contacts and the bifurcated contact are arranged such that they are turned in relation to each other and at least one lower edge of the insulation-piercing contact is supported on the plastic housing, so that the contact elements are captively held in the plastic housing when connecting forces occur on the insulation-piercing contacts. The plastic housing is in each case formed in two parts, the contact elements first being pushed into the first part of the housing and then the second part of the housing being latched onto the first part of the housing. A disadvantage of the known plug-in connectors for printed circuit boards is that they are relatively complex to produce.

The invention is therefore based on the technical problem of providing a plug-in connector for printed circuit boards which is simpler to produce.

For this purpose, the plastic housing is formed in one piece, the part receiving the bifurcated contacts being formed at least partly in a resilient manner. This achieves the effect that, when the plastic housing is fitted with the contact elements, it can be bent apart in order to introduce the contact elements and subsequently moves back again resiliently, whereby the contact elements are fixed. The one-part form of the plastic housing has the effect of simplifying the production of the plug-in connector, since now only one injection mold is required. Furthermore, no further plastic housing has to be fitted.

In a preferred embodiment, in the transitional region between the insulation-piercing contact and the bifurcated contact, the contact element is formed with two latching elements, which latch into latching receptacles of the plastic housing. The latching receptacles are furthermore preferably formed in this case as apertures in the respective housing wall.

In a further preferred embodiment, the bifurcated contacts are completely accommodated by the housing in the longitudinal direction. In this case furthermore grooves or guides in which at least the bifurcated contacts are guided are preferably formed in the inner sides of the housing walls. The actual contact regions of the bifurcated contacts in this case protrude beyond the grooves or guides.

In a further preferred embodiment, the plastic housing is formed such that it is at least partly slit at the side walls. On the one hand, this brings about the desired resilience. On the other hand, the slit form allows the plug-in connector also to be fitted onto wider printed circuit boards.

In a further preferred embodiment, the insulation-piercing contact and the bifurcated contact are arranged such that they are turned in relation to each other in the range of 45°. The arrangement of the contact elements of an insulation-piercing contact at an angle of about 45° is of advantage with regard to the connecting operation, an edge which can be used for support inevitably forming furthermore when the contact element is formed in one piece as a punched or bent part.

In a further preferred embodiment, the insulation-piercing contact and the bifurcated contact lie on a common center axis. The advantage of this embodiment is that the connecting forces occurring on the insulation-piercing contact bring about no bending moments, or insignificant bending moments, on the bifurcated contact. Furthermore, the plug-in connector can be made narrower with the same number of contact elements.

In a further preferred embodiment, the plug-in connector is latched on a front frame by means of a latching spring, it being possible for the plug-in connector to be released from the front side of the front panel by means of the latching spring. One possible configuration of such a latching spring is described in DE 101 41 449 A1 for use in the case of an adapter for optical-fiber plug-in connectors, reference hereby being made expressly to the statements made with respect to the latching spring.

The invention is explained in more detail below on the basis of a preferred exemplary embodiment. In the figures.

Figure 1:
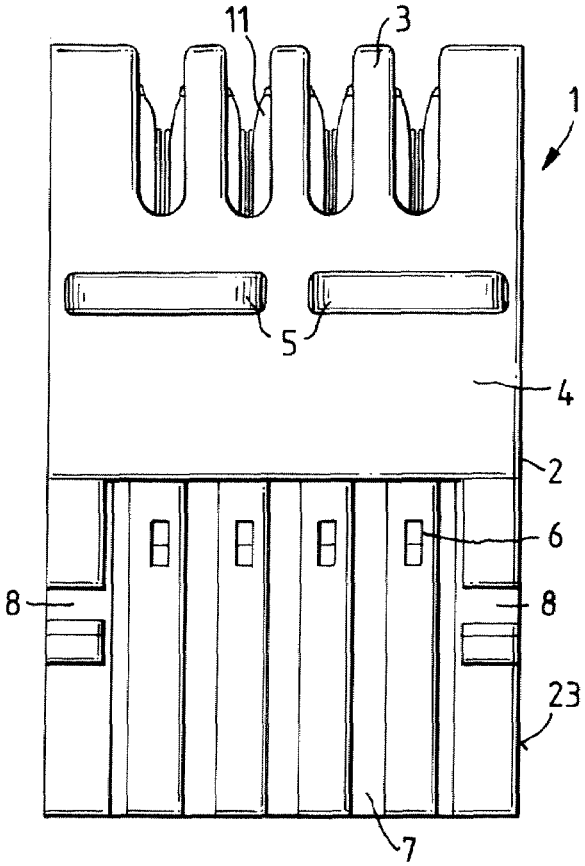
FIG. 1 shows a side view of a plug-in connector.
Figure 3:
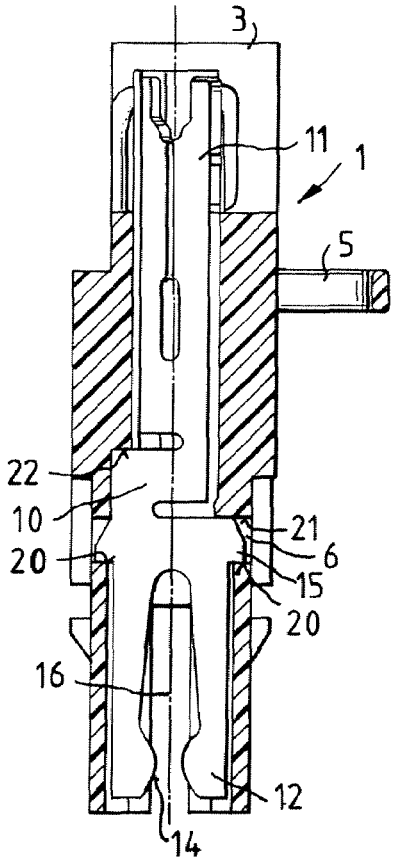
FIG. 3 shows a sectional representation through the plug-in connector.
Figure 2:
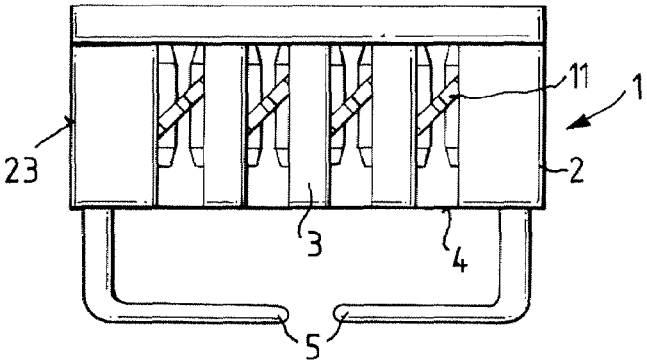
FIG. 2 shows a plan view of the plug-in connector.
Figure 4:
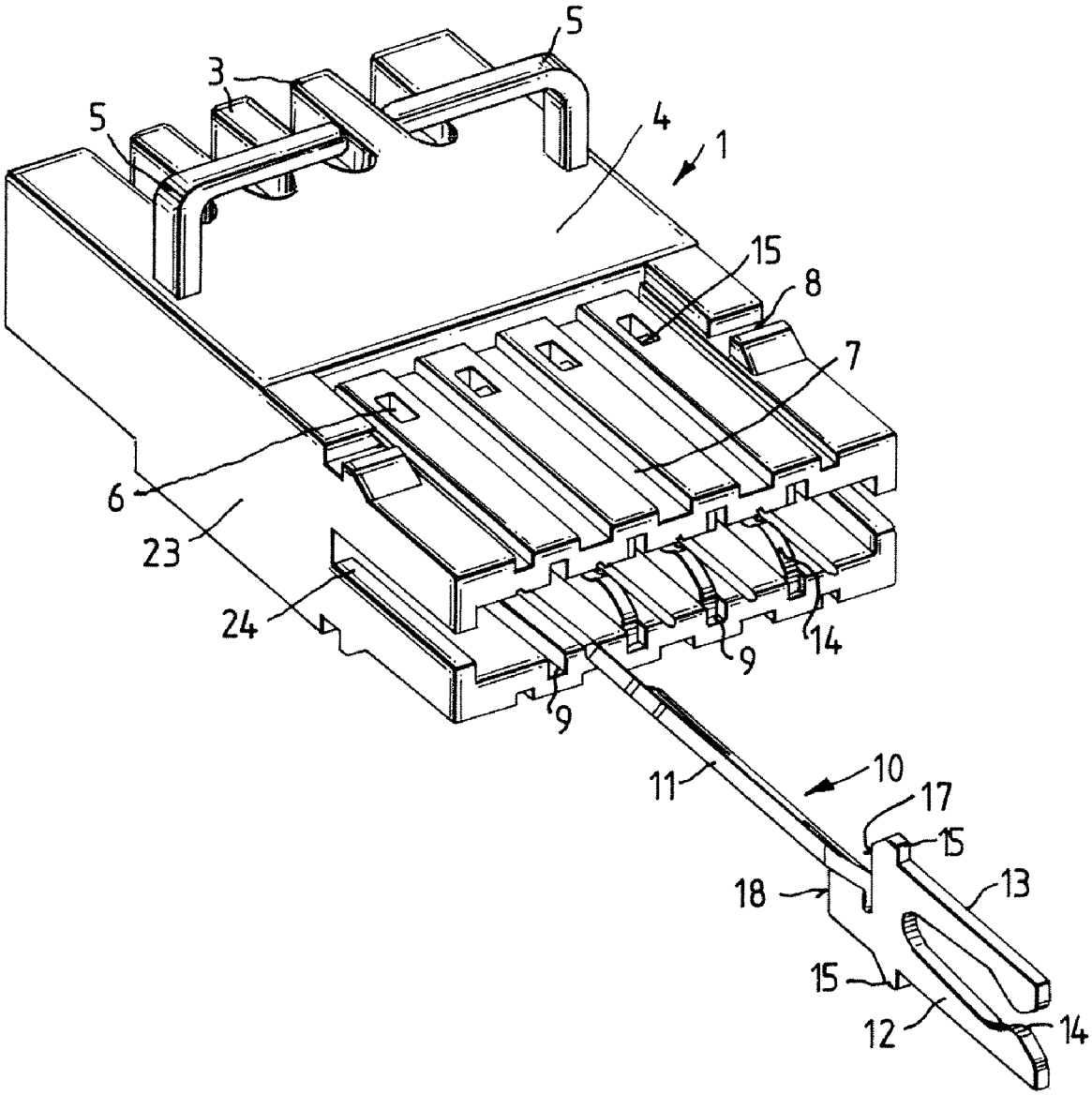
FIG. 4 shows a perspective representation of the plug-in connector with a pulled-out contact element.

In FIG. 1, the plug-in connector 1 is represented in a side view. The plug-in connector 1 comprises a one-part plastic housing 2. In the upper region, the plastic housing 2 is formed with clamping ribs 3, between which insulation-piercing contacts 11 of contact elements 10 are arranged (see FIG. 4). Arranged underneath the clamping ribs 3 on a wall of the housing is a wire guide 5. In the lower region of the plastic housing 2, where the bifurcated contacts 12 of the contact elements 10 lie, the housing has latching receptacles 6, which are formed as rectangular apertures. Between respective pairs of latching receptacles 6, the housing wall 4 has groove-shaped depressions 7. Furthermore, the housing wall 4 has at the sides two receptacles 8 for a locking mechanism (not represented), by means of which the plug-in connector 1 can be fastened for example to a metallic front frame. On the inner side, the housing wall 4 is formed with grooves 9, in which the bifurcated contacts 12 are guided with their side surfaces 13. The actual contact regions 14 of the bifurcated contacts 12 are in this case curved inward and protrude out of the groove 9. In the transitional region between the bifurcated contact 12 and the insulation-piercing contact 11, the contact element 10 has two detents 15, which, as can be seen in FIG. 3 or 4, are latched in the latching receptacles 6. It can also be seen in FIG. 3 that the insulation-piercing contact 11 and the bifurcated contact 12 lie on a common center axis 16. Furthermore, it can be seen in FIG. 3 how the detents 15 are supported in the downward direction on bearing surfaces 20 in the plastic housing 2. These bearing surfaces 20 absorb the connecting forces occurring during the wiring of the insulation-piercing contacts 11. Furthermore, the plastic housing has stop surfaces 21 and 22, which the contact element 10 comes up against with its edges 17 and 18. The side walls 23 of the plastic housing 2 also respectively have a slot 24 in the region of the bifurcated contacts 12. On account of the slot 24, the two housing walls 4 can be bent open resiliently with respect to each other, so that the contact elements 10 can be pushed with the detents 15 from below into the plastic housing 2, until the detents 15 latch in the latching receptacles 6.

LIST OF DESIGNATIONS

1 plug-in connector
2 plastic housing
3 clamping rib
4 housing wall
5 wire guide

6 latching receptacles
7 depression
8 receptacle
9 groove
10 contact element
11 insulation-piercing contact
12 bifurcated contact
13 side surface
14 contact region
15 detent
16 center axis
17 edge
18 edge
20 bearing surface
21 stop surface
22 stop surface
23 side wall
24 slot

The invention claimed is:

1. A plug-in connector for printed circuit boards, comprising:

a number of contact elements, the contact elements respectively having two connection sides, the one connection side being formed as an insulation-piercing contact for connecting of wires and the other connection side being formed as a bifurcated contact for contacting of terminal areas on a printed circuit board, each contact element defining a latching element positioned in a transitional region between the two connection sides; and a plastic housing, into which the insulation-piercing contacts of the contact elements can be inserted, the insulation-piercing contact and the bifurcated contact of each contact element being arranged such that they are turned in relation to each other and the contact element supporting itself with at least one edge on the plastic housing, so that the contact elements are captively held in the plastic housing when connecting forces occur on the insulation-piercing contacts, wherein the plastic housing is formed in one piece, the plastic housing having a portion that receives the bifurcated contacts, the portion being formed at least partly in a resilient manner to receive the latching element of each contact element.

2. The plug-in connector as claimed in claim 1, wherein, in the transitional region between the insulation-piercing contact and the bifurcated contact, each contact element is formed with two latching elements, which latch into latching receptacles of the plastic housing.

3. The plug-in connector as claimed in claim 1, wherein the bifurcated contacts are completely accommodated by the housing in the longitudinal direction.

4. The plug-in connector as claimed in claim 1, wherein the plastic housing is formed such that side walls of the plastic housing are at least partly slit.

5. The plug-in connector as claimed in claim 1, wherein the insulation-piercing contact and the bifurcated contact of each contact element are arranged such that they are turned in relation to each other about 45°.

6. The plug-in connector as claimed in claim 1, wherein the insulation-piercing contact and the bifurcated contact of each contact element lie on a common center axis.

7. A plug-in connector for printed circuit boards, comprising a number of contact elements, the contact elements respectively having two connection sides, the one connection side being formed as an insulation-piercing contact for connecting of wires and the other connection side being formed as a bifurcated contact for contacting of terminal areas on a printed circuit board, and a plastic housing, into which the insulation-piercing contacts of the contact elements can be inserted, the insulation-piercing contact and the bifurcated contact of each contact element being arranged such that they are turned in relation to each other and the contact element supporting itself with at least one edge on the plastic housing, so that the contact elements are captively held in the plastic housing when connecting forces occur on the insulation-piercing contacts, wherein the plastic housing is formed in one piece, the plastic housing having a portion that receives the bifurcated contacts, the portion being formed at least partly in a resilient manner to receive the latching element of each contact element;

wherein the insulation-piercing contact and the bifurcated contact of each contact element lie on a common center axis.

8. The plug-in connector as claimed in claim 7, wherein, in a transitional region between the insulation-piercing contact and the bifurcated contact, each contact element is formed with two latching elements, which latch into latching receptacles of the plastic housing.

9. The plug-in connector as claimed in claim 7, wherein the bifurcated contacts are completely accommodated by the housing in the longitudinal direction.

10. The plug-in connector as claimed in claim 7, wherein side walls of the plastic housing define partial slits.

11. The plug-in connector as claimed in claim 7, wherein the insulation-piercing contact and the bifurcated contact of each contact element are arranged such that they are turned in relation to each other about 45°.

* * * * *